US005979317A

United States Patent [19]

Singler

[11] Patent Number: 5,979,317

[45] Date of Patent: Nov. 9, 1999

[54] DRIVE FOR A PRINTING GROUP OF A ROTARY PRINTING MACHINE

[75] Inventor: Josef Singler, Wertingen, Germany

[73] Assignee: MAN Roland Druckmaschinen AG, Offenbach am Main, Germany

[21] Appl. No.: 09/097,215

[22] Filed: Jun. 12, 1998

[30] Foreign Application Priority Data

Jun. 12, 1997 [DE] Germany ..... 197 24 765

[51] Int. Cl.[6] ..... B41F 5/12

[52] U.S. Cl. ..... 101/218; 101/220

[58] Field of Search ..... 400/216, 217, 400/218, 248, 220, 221, 219, 177, 178, 179, 180, 181, 183, 184

[56] References Cited

U.S. PATENT DOCUMENTS

| | | | |
|---|---|---|---|
| 3,633,503 | 1/1972 | Tafel | 101/218 |
| 4,643,090 | 2/1987 | McKrell et al. | 101/218 |
| 4,651,641 | 3/1987 | Kawata et al. | 101/217 |
| 4,875,936 | 10/1989 | Hermach | 101/218 |
| 5,134,934 | 8/1992 | Knauer et al. | 101/218 |
| 5,333,546 | 8/1994 | Miyoshi et al. | 101/216 |

FOREIGN PATENT DOCUMENTS

| | | |
|---|---|---|
| 62 11 33 | 10/1994 | European Pat. Off. . |
| 64 40 48 | 3/1995 | European Pat. Off. . |
| 27 25 030 | 12/1978 | Germany . |

*Primary Examiner*—Christopher A. Bennett
*Attorney, Agent, or Firm*—Cohen, Pontani, Lieberman & Pavane

[57] ABSTRACT

A drive for a printing group of a rotary printing machine having a form cylinder and a transfer cylinder, the transfer cylinder being swivelably adjustable through an angle, the form cylinder and the transfer cylinder each having journals. The drive includes cylinder gears attached to the journals so as to be in toothed engagement, an electric motor with a drive spur gear that drives the transfer cylinder, and a spur gear mounted on the transfer cylinder journal. The drive spur gear of the motor drivingly engaging the spur gear on the journal of the transfer cylinder in a circumferential area of the spur gear lying from a diametral midpoint of the transfer cylinder in a direction of a vertex of the angle of the swivel adjustment of the transfer cylinder.

17 Claims, 7 Drawing Sheets

DRIVE FOR A PRINTING GROUP OF A ROTARY PRINTING MACHINE

BACKGROUND OF THE INVENTION

1. Field of the Invention

The invention relates to a drive for a printing group of a rotary printing machine.

2. Discussion of the Prior Art

European reference EP 0 644 048 A2 discloses the drive of a printing group that contains a form cylinder and a transfer cylinder. The printing group has its own motor, which drives the transfer cylinder via a toothed belt drive. The transfer cylinder and the form cylinder are in drive connection via cylinder gears on their journals. This reference also mentions the direct coupling or a gearwheel coupling of the motor to the transfer cylinder.

A direct coupling of a transfer cylinder to an electric motor is disclosed by European reference EP 0 621 133 A1. For readjustment during movements into and out of the ready-to-print position, the stator is eccentrically mounted in the same fashion as the transfer cylinder. During adjustment, these eccentric bushings are also activated. A device of this type is expensive.

In a gearwheel coupling of the drive motor, drive-in by a drive spur gear into the cylinder gear of the transfer cylinder is conceivable. During movements of the transfer cylinder into the shut-off position, which movements take the form of swiveling motions around the form cylinder, the center-to-center distance to the drive spur gear is disadvantageously influenced. The gearwheels have too little overlap or can slip completely out of engagement.

SUMMARY OF THE INVENTION

Accordingly, it is an object of the present invention to provide a gearwheel coupling of the electric motor to the transfer cylinder in which adjustment movements of the transfer cylinder have no lasting effect on the toothed engagement.

Pursuant to this object, and others which will become apparent hereafter, one aspect of the present invention resides in a drive for a printing group having a form cylinder and a transfer cylinder. The transfer cylinder is swivelably adjustable through an angle. The form cylinder and the transfer cylinder each have journals on which cylinder gears are attached so as to be in toothed engagement. An electric motor with a drive spur gear drives the transfer cylinder. A spur gear is mounted on the transfer cylinder journal and is in driving engagement with the drive spur gear of the motor in a circumferential area of the spur gear line from a diametral midpoint of the transfer cylinder in a direction of a vertex of the angle of the swivel adjustment of the transfer cylinder.

The arrangement of a spur gear on the journal of the transfer cylinder makes it possible to select a favorable engagement point for the drive spur gear of the electric motor for any desired adjustment curves for adjusting the transfer cylinder. During intervention in the area mentioned, the distance changes of the drive spur gear and the spur gear remain small, creating good drive conditions for the printing group, which in turn has an advantageous effect on print quality. The drive motor can be installed in a fixed-frame manner and does not need be arranged on the operator side. If the cylinder gear in the intervention area mentioned is accessible, it can also perform the function of the spur gear.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
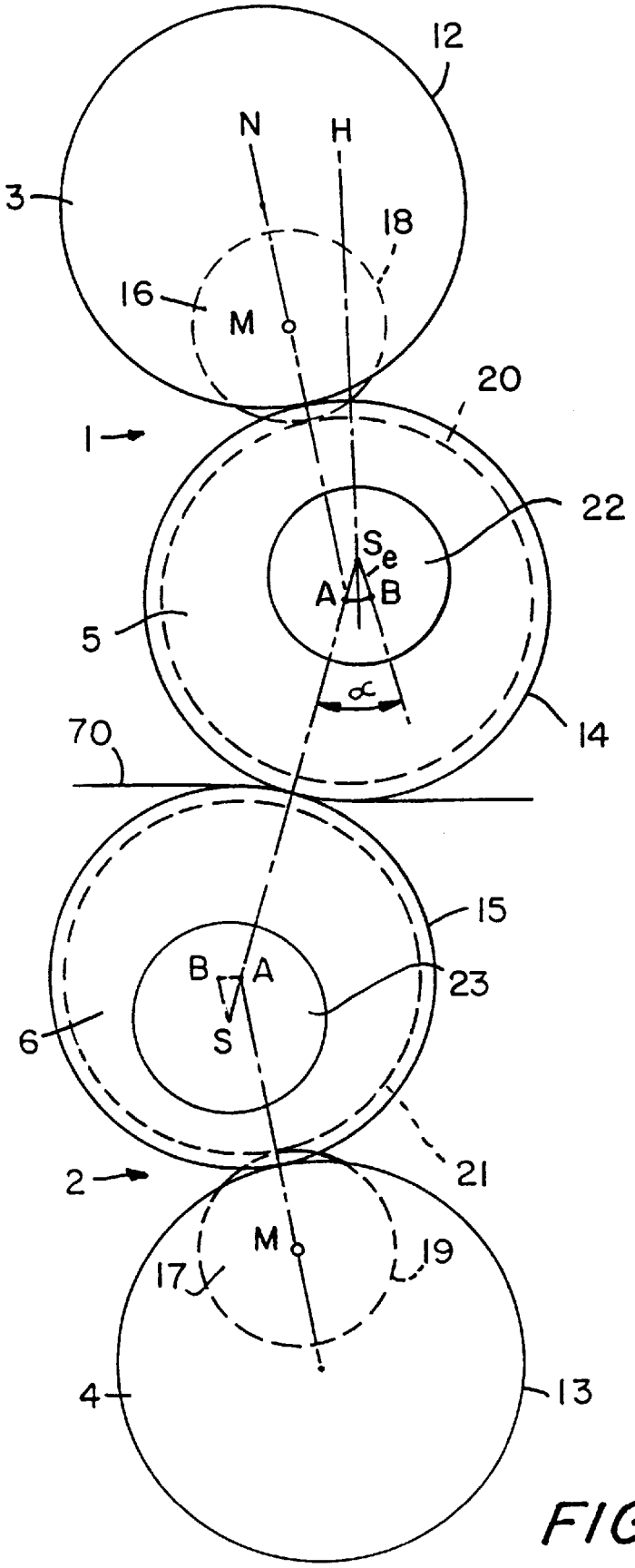
FIG. 1 schematically shows a cylinder arrangement of a double printing group.
Figure 2:
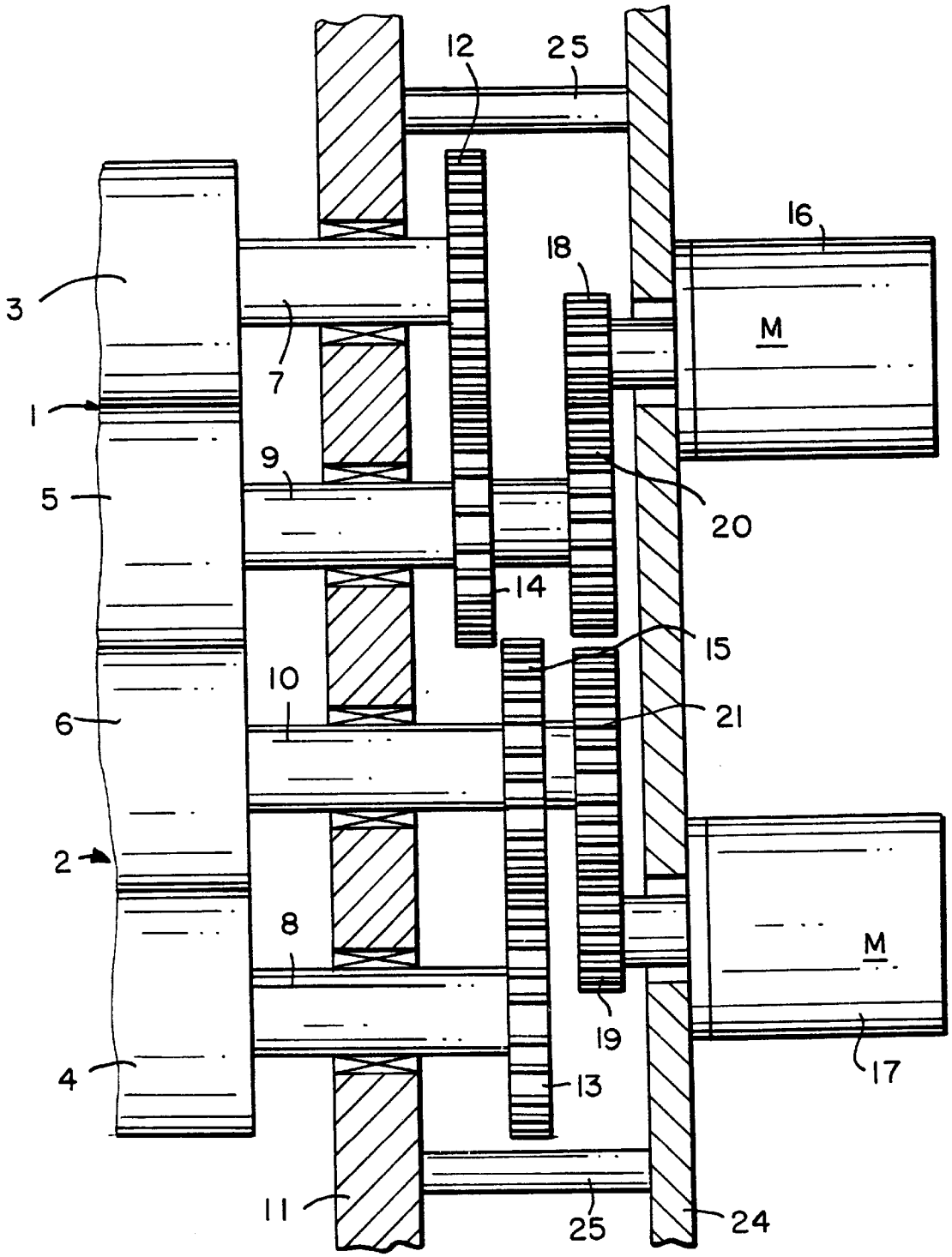
FIG. 2 is a side view of FIG. 1.

FIG. 1 shows the cylinder arrangement of a double printing group with the printing groups 1, 2. Each printing group 1, 2 contains a form cylinder 3, 4 and a transfer cylinder 5, 6. These cylinders 3 to 6 are mounted with their journals 7 to 10 in side walls. In the side view in FIG. 2, only the area of the drive-side side wall 11 with the drive described below is shown.

On their respective journals 7 to 10, the form and transfer cylinders 3 to 6 carry spur gears, described hereinafter as the cylinder gears 12 to 15. The cylinder gears 12, 14 are located on one plane and are in toothed engagement with each other, while the cylinder gears 13, 15, which are also in toothed engagement with each other, are located on a different plane. Thus, the cylinder gears 14, 15 are not in toothed engagement with each other. The cylinder gears 14, 15 could also be located on one plane and be embodied, to avoid toothed engagement, in a negatively corrected fashion. The cylinder gears 12 to 15 are advantageously straight-toothed, so that no measures are needed to protect the circumferential register from being influenced during lateral register adjustment. Each printing group 1, 2 has its own drive motor, specifically, an electric motor 16, 17. The electric motors 16, 17 drive, respectively, the drive spur gear 18, 19 on the spur gears 20, 21 on the journals 9, 10 of the transfer cylinders 5, 6. The spur gears 20, 21 are not in toothed engagement with each other. To this end, the spur gears 20, 21 are embodied with a smaller reference circle diameter than the cylinder gears 14, 15, e.g., with the same module but fewer teeth. However, the spur gears 20, 21 can also be negatively corrected or arranged on two different planes, in which case they have the same number of teeth as the cylinder gears 14, 15. The translation of the drive spur gear 18 or 19 and of the spur gear 20 or 21 can be 1:1 or greater than 1. In the latter case, electric motors with smaller dimensions can be selected. In the present example, the translation has been advantageously set at i=2. Even greater down-gearing is possible. The gearwheel step can be straight-toothed or, while attaining a particular running quality, helical. The transfer cylinders 5, 6 are mounted with their journals 9, 10 in eccentric bushings 22, 23, which are only indicated in FIG. 1. Detailed explanations are unnecessary, because bearings of this sort are familiar to those skilled in the art. Such a bearing is also described, for example, in German Application 197 08 728.0. The journals 7, 8 in the eccentric bushings 22, 23 are mounted with an eccentricity e in a manner offset relative to the outer diameter of the eccentric bushings 22, 23. In Position A, the transfer cylinders 5, 6 are in the ready-to-print position. The eccentric bushing 22 can be swiveled by the angle α into Position B, the away position. In Position B, the transfer cylinder 5 is positioned away from the form cylinder 3 and the transfer cylinder 6. The drive spur gear 18 engages in the circumferential area of the spur gear 20 located from the midpoint of the transfer cylinder 5 toward the vertex S of the angle α of the swivel adjustment of the transfer cylinder 5. As a result, during the movements of the rubber-blanket cylinder into and out of the ready-to-print position, the center-to-center distance of the spur gears 18, 20 does not increase impermissibly. In the example, the drive spur gear 18 is located on the connection line N of the centers of the form cylinder 3 and the transfer cylinder 5, in the ready-to-print Position A. The drive spur gear 18 can also advantageously be placed on the angle bisector H of the angle α or in the region between the lines N and H. Given arrangement on the angle bisector H, the circumferential backlash between the spur gears 18, 20 is equally small in the ready-to-print Position A as in the away Position B. The examples also apply to the arrangement of the drive spur gear 19, for which reason the explanation will not be repeated.

The electric motors 16, 17 are arranged in a fixed-frame fashion on the drive side. As a possible variant, the electric motors 16, 17 are screwed onto a bearing plate 24, which is attached to the side wall 11 by means of support bolts 25. However, the side wall 11 could be embodied, for example, as a box wall and can carry screw surfaces at the desired distance. Repetitive details of the attachments of the electric motors 16, 17 will not be discussed in reference to subsequent examples.

The electric motor 16, by means of the drive spur gear 18, drives the spur gear 20 and thus the transfer cylinder 5. From the transfer cylinder 5, by means of the spur gear step formed by the cylinder gears 14, 12, the form cylinder 3 is driven. At the same time and independent of this, the printing group 2 is driven by means of the electric motor 17 via the gearwheels 19, 21, 15 and 13.

Figure 3:
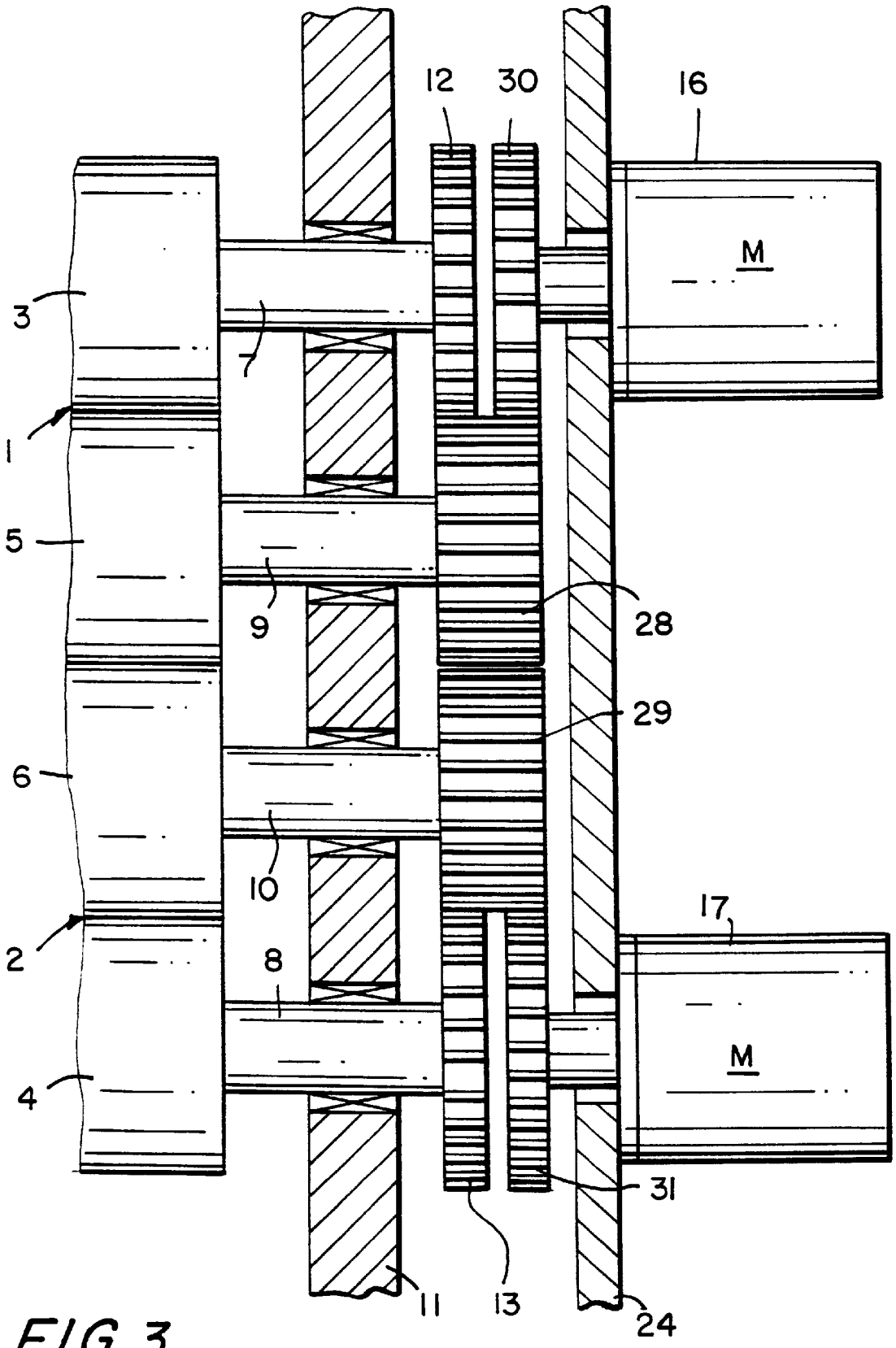
FIG. 3 is a further embodiment of FIG. 2.

In the following examples, for the sake of simplicity, the same item numbers are used for recurring or basically similar components. FIG. 3 shows a double printing group with the printing groups 1 and 2, whose form and transfer cylinders 3 to 6 are mounted with their journals 7 to 10 in the side wall 11. On each journal 7 and 8 is mounted a straight-toothed cylinder gear 12, 13. The respective cylinder gears 12, 13 are in toothed engagement with a broad gearwheel 28, 29 attached to the journals 9, 10. To ensure that the broad gearwheels 28, 29 are out of engagement, the broad gearwheels 28, 29 are embodied with a suitable negative tooth-profile modification. In each case, the tooth-profile modification factor is approximately x=−1. The respective drive spur gears 30, 31 of the electric motors 16, 17 engage into the broad gearwheels 28, 29. The eccentric bushings for mounting the transfer cylinder 5, 6 are arranged in a manner analogous to FIG. 1, for which reason no further description is given. The possible selection of the circumferential area of the spur gear into which the drive spur gear 30 engages, here, the broad gearwheel 28, is also analogous to the example in FIGS. 1 and 2. A concentric position relative to the cylinder gear 12 is selected. The translation i of the drive spur gear 30 and the broad gearwheel 28 is advantageously 1 or larger.

The electric motor 16, via the drive spur gear 30 and the broad gearwheel 28, drives the transfer cylinder 5 and, from the broad gearwheel 28 via the cylinder gear 12, the form cylinder 3. The descriptive explanations also apply to printing group 2.

Figure 4:
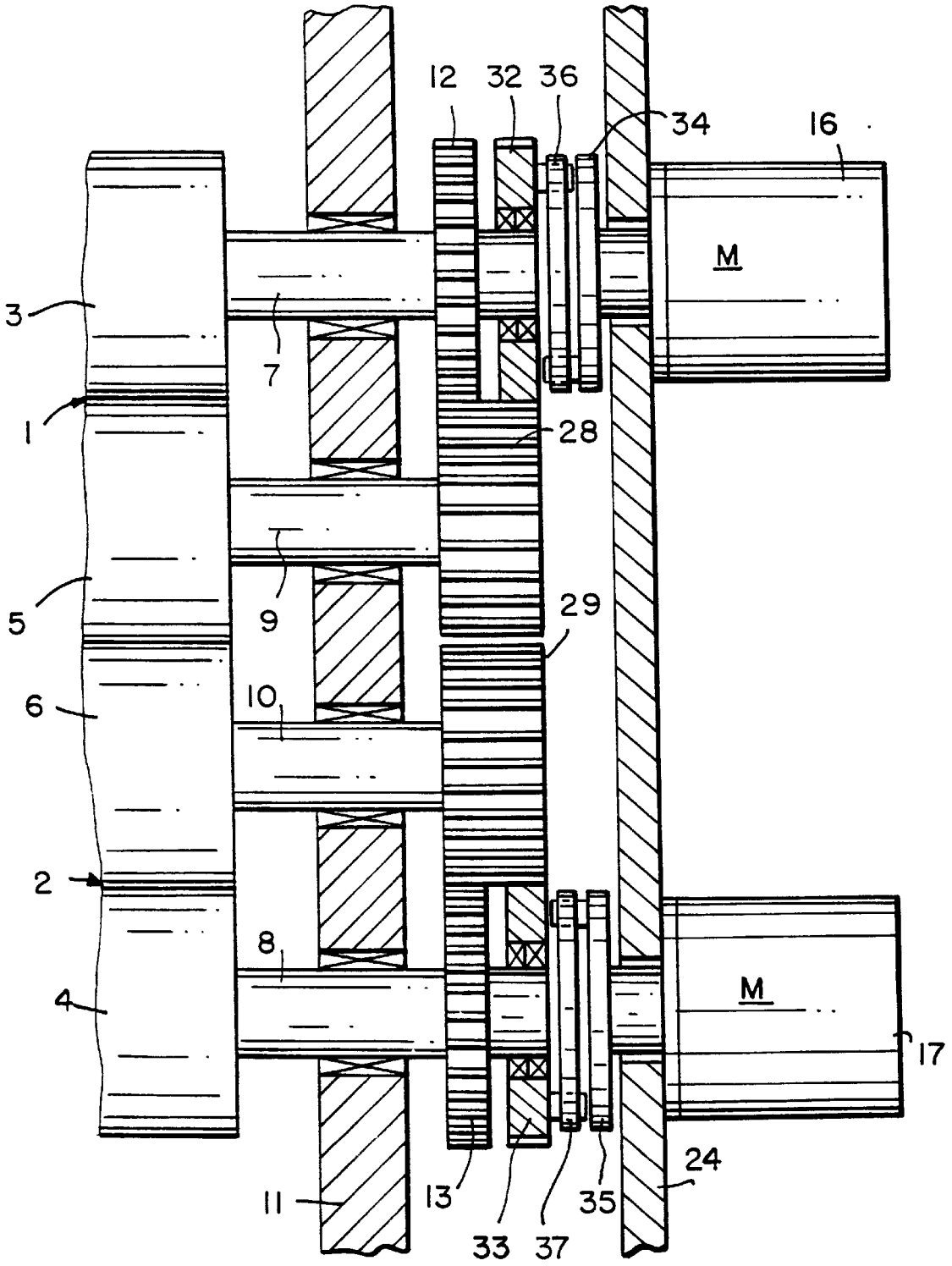
FIG. 4 is a further embodiment of FIG. 3.

The printing groups 1, 2 of the double printing group shown in FIG. 4 are largely the same as those in FIG. 3. The substantive difference is that the drive spur gears 32, 33 of the electric motors 16, 17 are mounted on the journals 7, 8 of the form cylinders 3, 4 by bearings. In practical terms, the electric motors 16, 17 carry coupling halves 34, 35, which are in drive connection with the drive spur gears 32, 33 via coupling disks 36, 37.

The electric motor 16, via the coupling halve 34, the coupling disk 36, the drive spur gear 32 and the broad gearwheel 28, drives the transfer cylinder 5. The latter, in turn, by means of the broad spur gear 28 and the cylinder gear 12, drives the form cylinder 3. Analogously, the printing group 2 is driven by the electric motor 17 via the coupling halve 35, the coupling disk 37, the drive spur gear 33, the broad gearwheel 29 and the cylinder gear 13.

Figure 5:
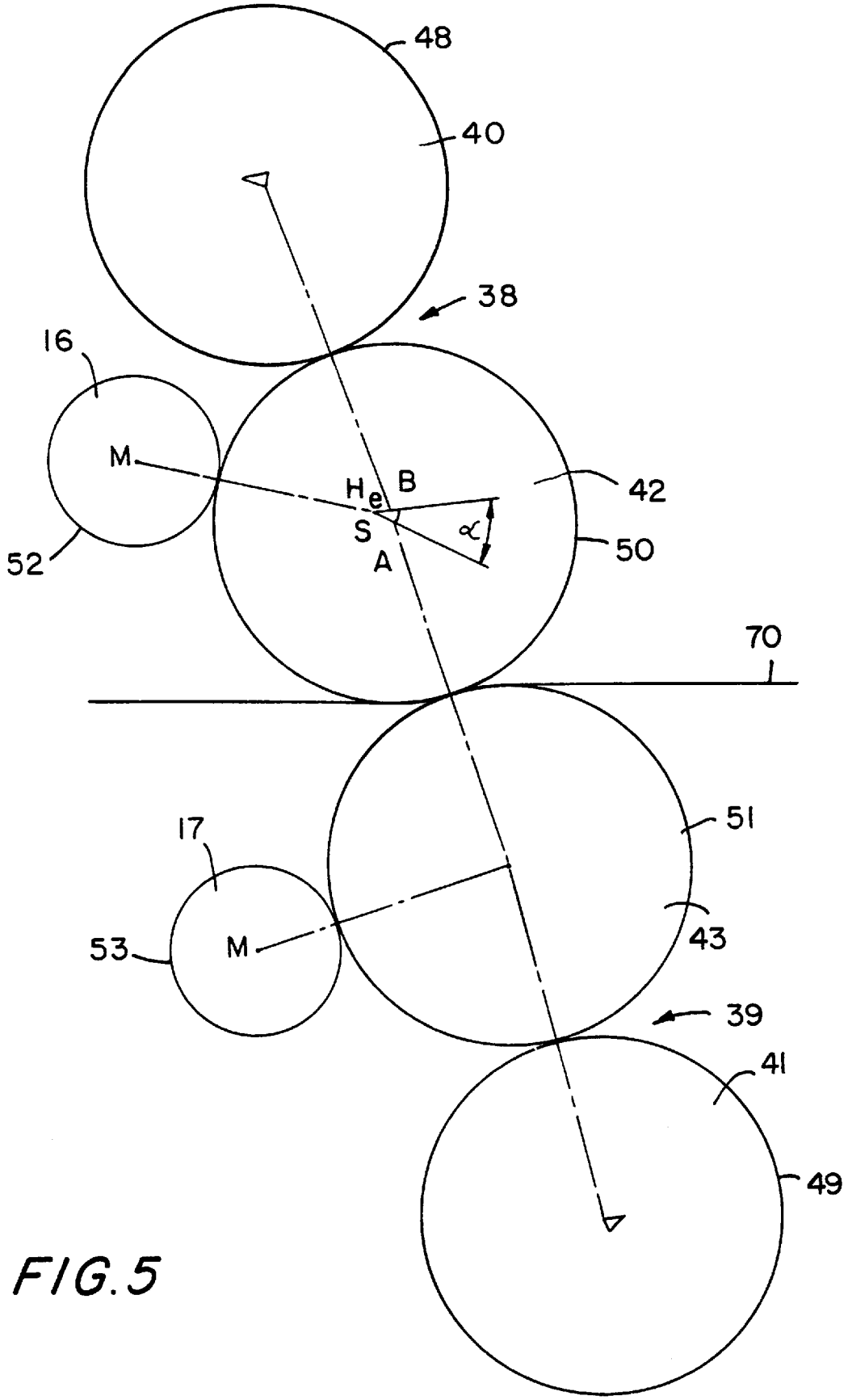
FIG. 5 is a further embodiment of a cylinder arrangement of a double printing group.
Figure 6:
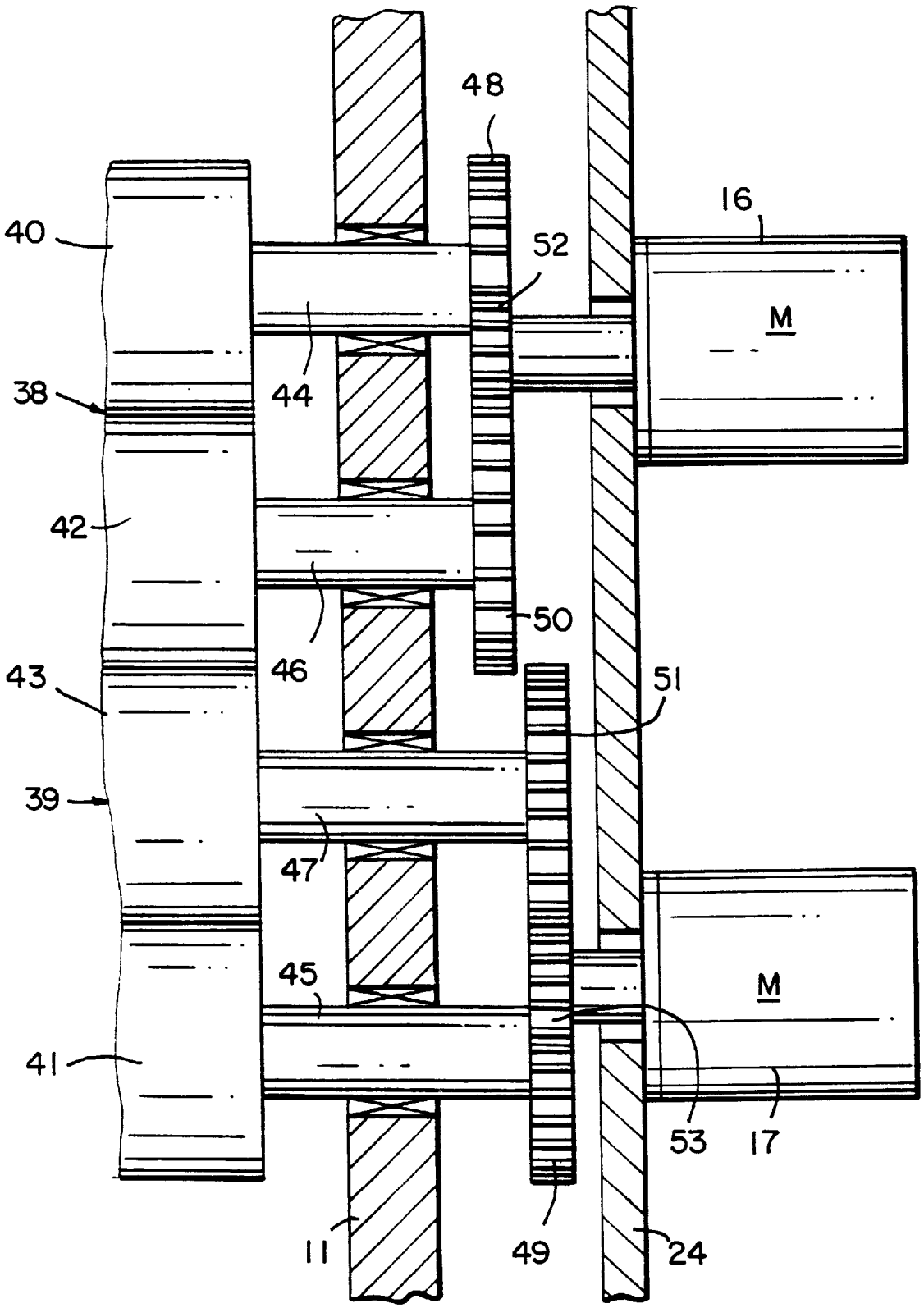
FIG. 6 is a side view of FIG. 5.

FIG. 5 shows a double printing group with two printing groups 38, 39, each of which contains a form cylinder and a transfer cylinder 40 to 43. These cylinders 40 to 43 are mounted with their journals 44 to 47 in side walls 11 (FIG. 6). Mounted on the respective journals 44 to 47 is a cylinder gear 48 to 51, by means of which the form and transfer cylinders 40, 42 or 41, 43 of a printing group 38, 39 are in drive connection. The cylinder gears 48, 50 of the printing group 38 are thereby located on a different plane than the cylinder gears 49, 51 of the printing group 39. To ensure that the transfer cylinders 46, 47 are not in drive connection, use can also be made of the aforementioned possibility of a negative tooth-profile modification of the cylinder gears 50, 51.

In contrast to the examples described above, the form and transfer cylinders 40 to 43 in FIG. 5 are located substantially in one plane. As a result, during away-positioning, three cylinders 40 to 42 must be adjusted, while only one cylinder, e.g., here, the transfer cylinder 43, can remain stationary. The form cylinders 40, 41 and the transfer cylinder 42 are swivelable in the manner indicated in FIG. 1 by means of eccentric bushings, so no explanation will be repeated. However, the direction from the midpoint of the transfer cylinder 42 to the vertex S of the angle α of the swivel adjustment of the transfer cylinder 42 differs. The circumferential area of the cylinder gear 50 located in this direction is not blocked by the cylinder gear 48. As a result, the drive spur gear 52 of the electric motor 16 can directly engage into the cylinder gear 50, and no further spur gear is needed on the journal 46. Advantageously, the drive spur gear 52 is placed on the angle bisector H of the angle α. The drive spur gear 52 can also be arranged away from the angle bisector H in the direction of the transfer cylinder 43 or the transfer cylinder 42. In this case, however, an increase in circumferential backlash between the drive spur gear 52 and the cylinder gear 50 must be tolerated when the transfer cylinder 50 is located in the away Position B. An arrangement of the drive spur gear 52 above the angle bisector (i.e., toward the form cylinder 40) is disadvantageous because, in this case, upon a changeover into the ready-to-print Position A, there is enlargement in the distance between the drive spur gear 52 and the transfer cylinder 50 and thus increased circumferential backlash. The electric motor 17, by means of a drive spur gear 53, drives the cylinder gear 51. The engagement point can be selected as desired, because the transfer cylinder 51 is stationary. Advantageously, the cylinder gears 48 to 51 as well as the drive spur gears 52, 53 are embodied in a straight-toothed fashion. The translation of the spur gear steps formed by the spur gears 52 and 50 or 53 and 51 has been selected, for example, at i=2.

Figure 7:
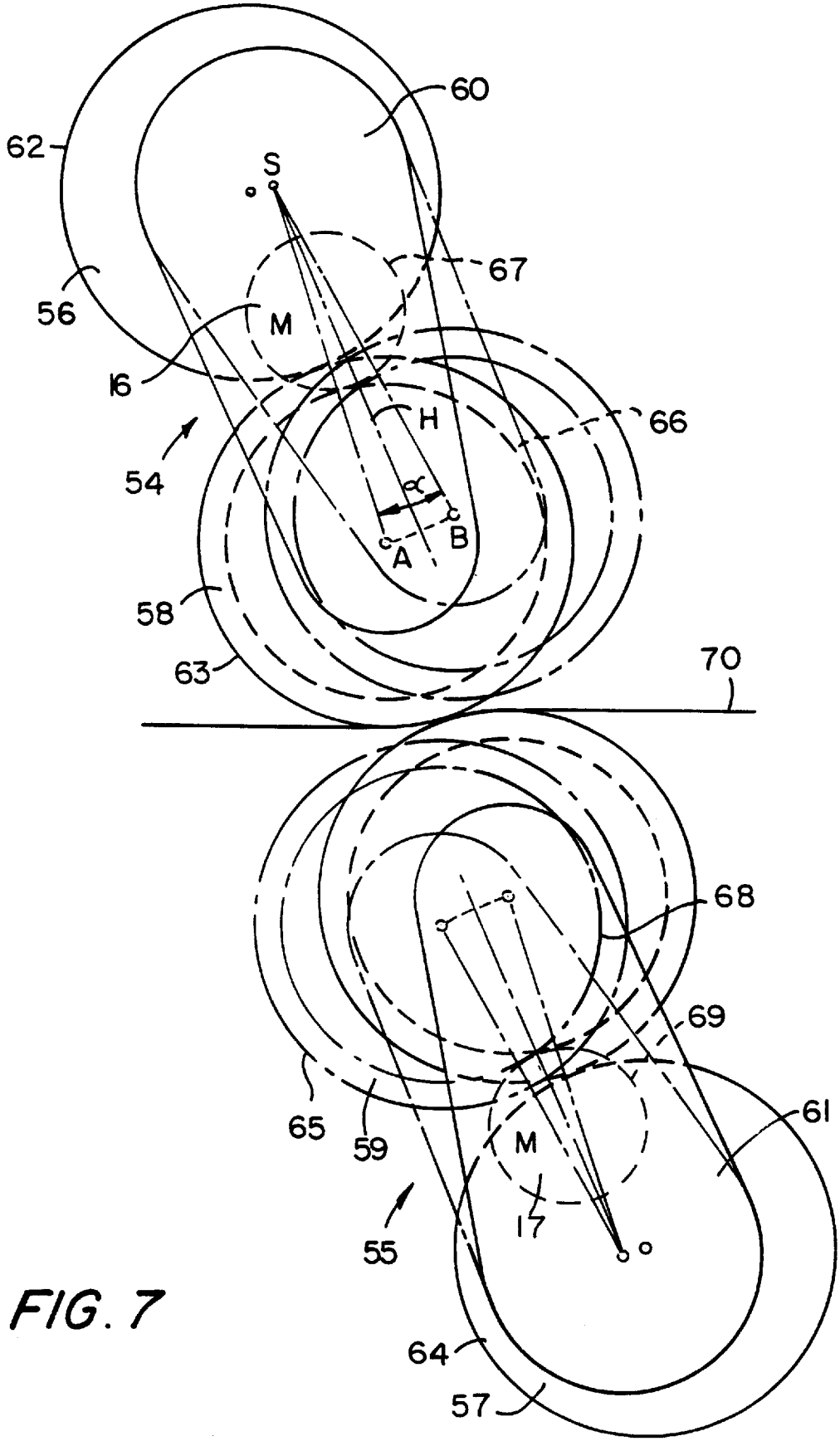
FIG. 7 shows a double printing group with transfer cylinders mounted in levers.

FIG. 7 shows a double printing group with the printing groups 54 and 55. Each printing group 54, 55 contains a form cylinder 56, 57 and a transfer cylinder 58, 59. Here, the transfer cylinders 58, 59 are not mounted, for adjustment, with their journals in eccentric bushings, but rather in swivelable levers 60, 61. Options for the arrangement of such levers 60, 61 on the side walls is disclosed in the aforementioned German Application 197 08 728.0, so that this is known to those skilled in the art and no further explanation is needed. As in FIG. 2, the form cylinder 56 and the transfer cylinder 58 are in toothed engagement by means of the cylinder gears 62, 63, while the form cylinder 57 and the transfer cylinder 59 are in toothed engagement by means of the cylinder gears 64, 65. The transfer cylinders 58, 59 are not in drive connection. Their cylinder gears 63, 65 are, for example, arranged on two different planes.

With the levers 60, 61, large adjustment angles a for the transfer cylinders 58, 59 are possible. This means that printing groups such as the printing groups 54, 55 can advantageously be used as imprint units (see German Application 197 08 728.0). The angle $\alpha$ of the swivel adjustment for the lever 60 is shown in FIG. 7. Further, the transfer cylinders 58, 59 are shown in double lines in the swiveled positions. The transfer cylinder 58 also carries, on a journal, a spur gear 66, in whose circumferential area from the midpoint of the transfer cylinder 58 in the direction of the vertex S of the angle $\alpha$, the drive spur gear 67 of a motor 16 engages (analogous to the drive spur gear 18 and the spur gear 20 in FIG. 2). The drive spur gear 67 is advantageously arranged on the angle bisector H of the angle $\alpha$. It can also be arranged in the area left of the angle bisector H. In this case, however, when the transfer cylinder 58 is in the away position (Position B), greater circumferential backlash occurs. In Position B, the printing group 54 is moved into the away position, for example, for a change of printing form. The transfer cylinder 59 is driven analogously. The transfer cylinder 59 carries a spur gear 68, into which engages the drive spur gear 69 of an electric motor 17. The electric motors 16, 17 (not shown) are advantageously mounted on a bearing plate attached at a distance to the side wall.

The printing group 54 is driven by the motor 16 by means of its drive spur gear 67 driving the spur gear 66. The transfer cylinder 58 driven in this fashion drives the form cylinder 56 via the cylinder gears 63 and 62. Analogously, the printing group 55 is driven by the motor 17 by means of its drive spur gear 69, the spur gear 68 and the cylinder gears 65 and 64.

In the examples discussed, the printing groups 1, 2, 38, 39, 54, 55 are offset rotary printing groups that print both sides of a web 70 running through the transfer cylinders 5, 6, 42, 43, 58, 59. The inking mechanisms and, in some cases, wetting mechanisms, on the form cylinders 3, 4, 40, 41, 56, 57 are not shown. Advantageously, the inking mechanisms and, as applicable, wetting mechanisms are in drive connection with the form cylinder, as a result of which they act in a braking fashion on the form cylinder and ensure constant contact of the drive tooth flanks of the cylinder gear wheels 12 to 15, 28, 29, 48 to 51, 62 to 65. This also applies to the other toothed gears leading to the electric motors 16, 17. Optionally, the cylinder gears 12 to 15, 28, 29, 48 to 51, 62 to 65 can also be secured with auxiliary gearwheels against tooth-profile change.

The illustrated drives can also be used for printing groups that operate in other indirect printing processes, for example, indirect gravure printing. In this case, the form cylinders 3, 4 40, 41, 56, 57 are equipped, instead of with an offset form, with an gravure form, which is inked, for example, by means of a chamber blade.

Instead of completing the printing groups 1, 2, 38, 39, 54, 55 with printing groups 1, 2, 38, 39, 54, 55 of the same type, so as to form double printing groups, it is possible to complete them with a counter-pressure cylinder, so as to form three-cylinder printing groups. The counter-pressure cylinder can also be a satellite cylinder, on which are arranged multiple printing groups, each containing a form cylinder and a transfer cylinder. In all cases, the counter-pressure cylinder can be driven by its own electric motor or can carry on its journal, a cylinder gear in toothed engagement with a cylinder gear 14, 15, 28, 29, 50, 51, 63, 65 of a transfer cylinder 5, 6, 42, 43, 58, 59.

The invention is not limited by the embodiments described above which are presented as examples only but can be modified in various ways within the scope of protection defined by the appended patent claims.

I claim:

1. A combination comprising: a printing group of a rotary printing machine; and a drive for the printing group, the printing group including a form cylinder and a transfer cylinder, the transfer cylinder being mounted so as to be swivelably adjustable through an angle between a print position and a non-print position, the from cylinder and the transfer cylinder each having journals, the drive comprising:

cylinder gears attached to the journals so as to be in toothed engagement;

an electric motor with a drive spur gear that drives the transfer cylinder; and a spur gear mounted on the transfer cylinder journal, the drive spur gear of the motor drivingly engaging the spur gear on the journal of the transfer cylinder in a circumferential area of the spur gear facing the form cylinder and lying from a diametral midpoint of the transfer cylinder in a direction of a vertex of the angle of the swivel adjustment of the transfer cylinder, the drive of the motor being arranged in a region of the angle bisector of the angle of the swivel adjustment of the transfer cylinder, the drive spur gear of the motor being arranged on a line connecting centers of the transfer cylinder and the form cylinder in the print position.

2. A combination as defined in claim 1, wherein the drive spur gear of the motor is arranged concentrically relative to the cylinder gear of the form cylinder.

3. A combination as defined in claim 2, wherein the drive spur gear of the motor is mounted rotatably on the journal of the form cylinder.

4. A combination as defined in claim 1, wherein the cylinder gears are mounted on the journals so as to lie in a plane, the drive spur gear of the motor being arranged in a plane next to the plane of the cylinder gears.

5. A combination as defined in claim 4, wherein the cylinder gear of the transfer cylinder and the spur gear are embodied as a single broad gearwheel that extends over the planes of the cylinder gears and the drive spur gear.

6. A combination as defined in claim 1, wherein the cylinder gears are mounted on the journals so as to lie in a plane, the drive spur gear of the motor being arranged on the plane of the cylinder gears so as to intermesh with the cylinder gear of the transfer cylinder.

7. A combination as defined in claim 1, wherein the drive spur gear and the spur gear are configured to have a translation of i>1.

8. A combination as defined in claim 1, wherein a further printing group with its own drive and a transfer cylinder is provided, the transfer cylinder of the further printing group being arranged to act as a counter-pressure cylinder, whereby the cylinder gears and the spur gears on the journals of the transfer cylinders of the two drives are not in toothed engagement with each other.

9. A combination as defined in claim 8, wherein the cylinder gears and the spur gears have teeth with tooth-profile modifications such that their outside circles are separated.

10. A combination as defined in claim 8, wherein the cylinder gears and the spur gears of the two drives are arranged on different planes.

11. A combination as defined in claim 8, wherein the spur gears are configured to have a smaller partial circle diameter than the cylinder gears.

12. A combination as defined in claim 1, wherein the printing group includes a counter pressure cylinder, the counter-pressure cylinder having a journal, a cylinder gear being mounted on the journal of the counter-pressure cylinder, the cylinder gear of the counter-pressure cylinder being in toothed engagement with the cylinder gear of the transfer cylinder.

13. A combination as defined in claim 1, and further comprising side walls and eccentric bushing means for mounting the transfer cylinder swivelably in the side walls.

14. A combination as defined in claim 1, and further comprising the walls and sleeves swivelably mounted to the side walls, the transfer cylinder being mounted in the levers.

15. A combination as defined in claim 1, and further comprising a side wall to which the cylinder journals are mounted, and a bearing plate mounted to the side wall, the electric motor being attached to the bearing plate.

16. A combination as defined in claim 1, wherein the printing group is an offset printing group.

17. A combination as defined in claim 1, wherein the printing group is a gravure printing group.

* * * * *